US006044682A

United States Patent [19]

Cheng

[11] Patent Number: 6,044,682

[45] Date of Patent: Apr. 4, 2000

[54] WIRE PRODUCT MANUFACTURING APPARATUS

[75] Inventor: Ming-Yih Cheng, Taoyuan, Taiwan

[73] Assignee: Minyu Machinery Corp., Ltd., China

[21] Appl. No.: 09/226,446

[22] Filed: Jan. 6, 1999

[51] Int. Cl.[7] ..... B21F 1/00

[52] U.S. Cl. ..... 72/307

[58] Field of Search ..... 72/307, 311, 386, 72/135, 137, 140, 142, 130

[56] References Cited

U.S. PATENT DOCUMENTS

| | | | |
|---|---|---|---|
| 3,974,676 | 8/1976 | Eaton | 72/307 |
| 4,630,459 | 12/1986 | Elliott | 72/307 |
| 4,947,670 | 8/1990 | Wu | 72/130 |
| 5,363,681 | 11/1994 | Speck | 72/137 |
| 5,839,312 | 11/1998 | Itaya | 72/142 |

FOREIGN PATENT DOCUMENTS

| | | | |
|---|---|---|---|
| 258109 | 3/1988 | France | 72/307 |

*Primary Examiner*—Daniel C. Crane

*Attorney, Agent, or Firm*—Ostrolenk, Faber, Gerb & Soffen, LLP

[57] ABSTRACT

A wire product manufacturing apparatus includes a wire guiding section which receives a wire from a wire supply and guides the wire toward a wire feeding device. The wire feeding device feeds the wire into a wire rotating section comprising a releasable wire holding device which selectively allows the wire received from the wire feeding device to pass through and into a wire shaping device comprising a central bore and a plurality of tool sets surrounding the central bore. The central bore allows a length of the wire, determined and controlled by the wire feeding device, to extend therethrough so as to allow tools on the tool sets to operate on the wire for forming a wire product. The wire holding device is selectively driven by means of for example a motor to rotate the wire about its own central axis and make a desired angular displacement in a controlled manner so as to facilitate the manufacturing of the wire product.

8 Claims, 6 Drawing Sheets

WIRE PRODUCT MANUFACTURING APPARATUS

FIELD OF THE INVENTION

The present invention relates generally to a wire product manufacturing apparatus which makes wire products from a continuous metal wire and in particular to a wire product manufacturing apparatus in which a rotating device is incorporated to rotate the metal wire its own central axis in the manufacturing process of the product so that the number of tool sets needed to bend or otherwise handle the wire may be reduced and the cost cut down.

BACKGROUND OF THE INVENTION

Wire products, such as springs or hangers, made by bending, twisting, winding a metal wire are traditionally mass-manufactured by means of a wire product manufacturing device. The conventional wire product manufacturing device comprises a plurality of guide rollers that guide a metal wire forwarded from a supply and a plurality of feeding roller pairs each comprising an upper roller and a lower roller facing each other to pinchingly receive the metal wire supplied through the guide rollers and thus drive the metal wire forward for feeding the wire into a shaping device. The shaping device comprises a base having a head on which a central bore is provided. A number of tool sets are provided on the base to surround the central bore and radially extending therefrom. The metal wire fed to the shaping device is moved through the central bore. Each of the tool sets has a tool thereon which is movable to engage the metal wire extending through the central bore for operating on the metal wire to make the desired wire product.

For different wire products, there may be different number of bending operations to be performed on the metal wire so that the quantity of the tool sets has to be adjusted in order to match the requirements of different wire products. The tool sets are positioned at angular locations corresponding to the desired bending angles of the bendings to be formed on the metal wire. Thus, in case a great number of bending operations have to be formed on a single length of metal wire in order to manufacture a wire product, there should be a great number of tool sets to operate on the metal wire. This increases the tool cost.

Further, the greater the number of the tool sets is, the more the time and labor needed to install and/or remove the tool sets. This also increases the cost in manufacturing the wire products.

Thus it is desirable to have a wire product manufacturing apparatus which overcomes the problems encountered in the prior art.

OBJECTS OF THE INVENTION

Therefore, an object of the present invention is to provide a wire product manufacturing apparatus comprising a wire rotating device which allows the metal wire to be rotated about its own central axis in a controlled manner during the manufacturing process of the wire products so as to reduce the number of tool sets needed in manufacturing the wire product.

Another object of the present invention is to provide a wire product manufacturing apparatus which allows the wire product to be manufactured with less number of tool sets as compared with the prior art so that time and labor needed to install/remove the tool sets are reduced and as a consequence, a cut-down of the overall cost may be obtained.

To achieve the above objects, in accordance with the present invention, there is provided a wire product manufacturing apparatus, comprising a wire guiding section which receives a wire from a wire supply and guides the wire toward a wire feeding device. The wire feeding device feeds the wire into a wire rotating section comprising a releasable wire holding device which selectively allows the wire received from the wire feeding device to pass through and into a wire shaping device comprising a central bore and a plurality of tool sets surrounding the central bore. The central bore allows a length of the wire, determined and controlled by the wire feeding device, to extend therethrough so as to allow tools on the tool sets to operate on the wire for forming a wire product. The wire holding device is selectively driven by means of for example a motor to rotate the wire about its own central axis and make a desired angular displacement in a controlled manner so as to facilitate the manufacturing of the wire product.

BRIEF DESCRIPTION OF THE DRAWINGS

The present invention will be better understood from the following description of a preferred embodiment thereof, which is illustrative and not limitative, with reference to the attached drawings, wherein.

DETAILED DESCRIPTION OF THE PREFERRED EMBODIMENTS

Figure 1:
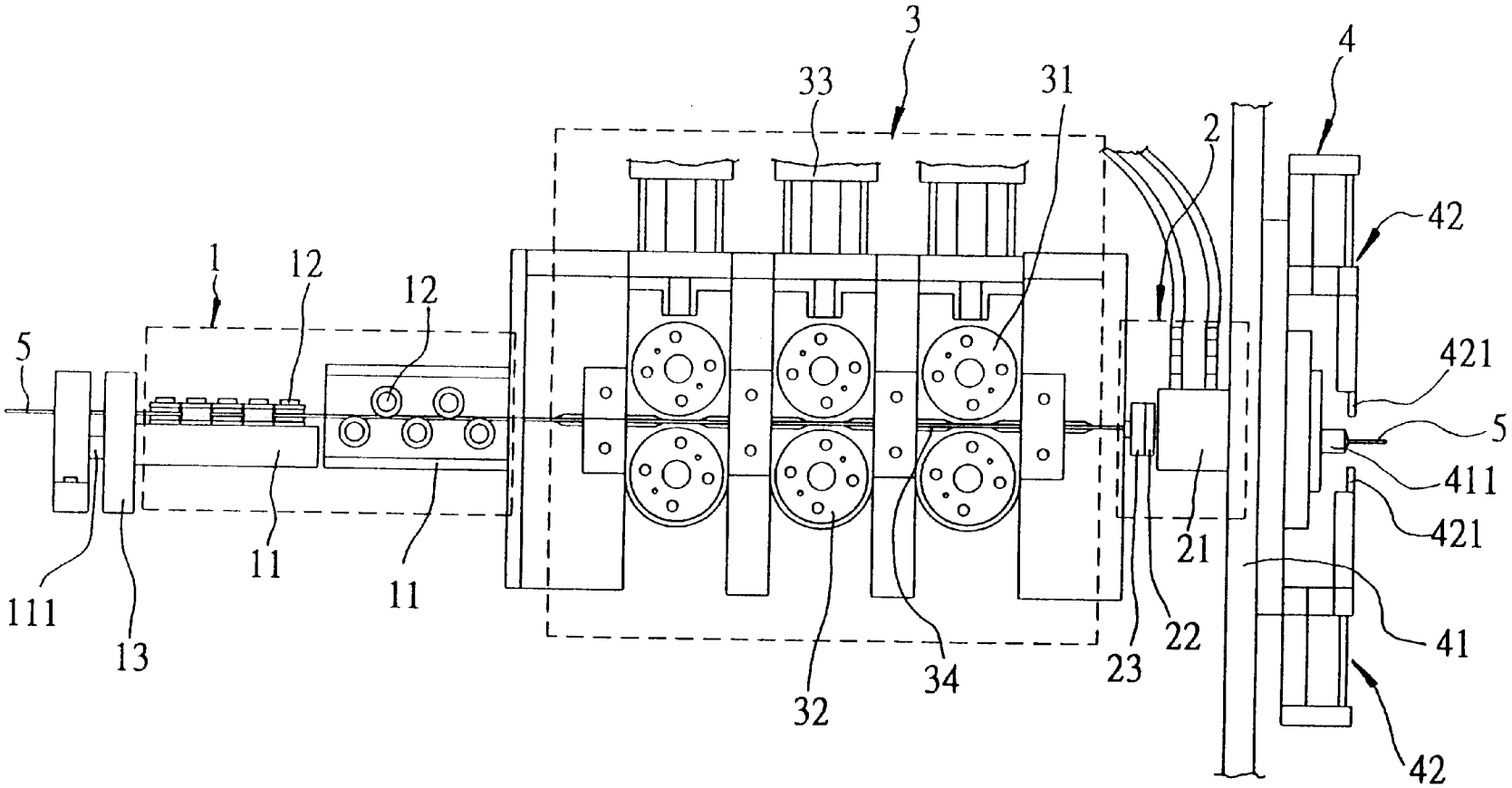
FIG. 1 is a schematic side elevational view showing a wire product manufacturing apparatus in accordance with the present invention.

With reference to the drawings and in particular to FIG. 1, wherein a wire product manufacturing apparatus constructed in accordance with the present invention for making a wire product from a metal wire is shown the wire product manufacturing apparatus comprises, in sequence, a wire guiding section 1, wire feeding means 3, a wire rotating section 2 and shaping means 4. The wire guiding section 1 comprises two roller supports 11 which are arranged to be in perpendicular orientations. The roller supports 11 are rotatably supported on a stationary base 13 by means of a rotatable shaft 111. Each of the roller supports 11 has a plurality of guide rollers 12 supported thereon, which are arranged in two rows in an alternate fashion so as to guide a metal wire 5 from a supply (not shown) toward the wire feeding means 3 from which the wire is fed to and through the wire rotating section 2.

Figure 4:
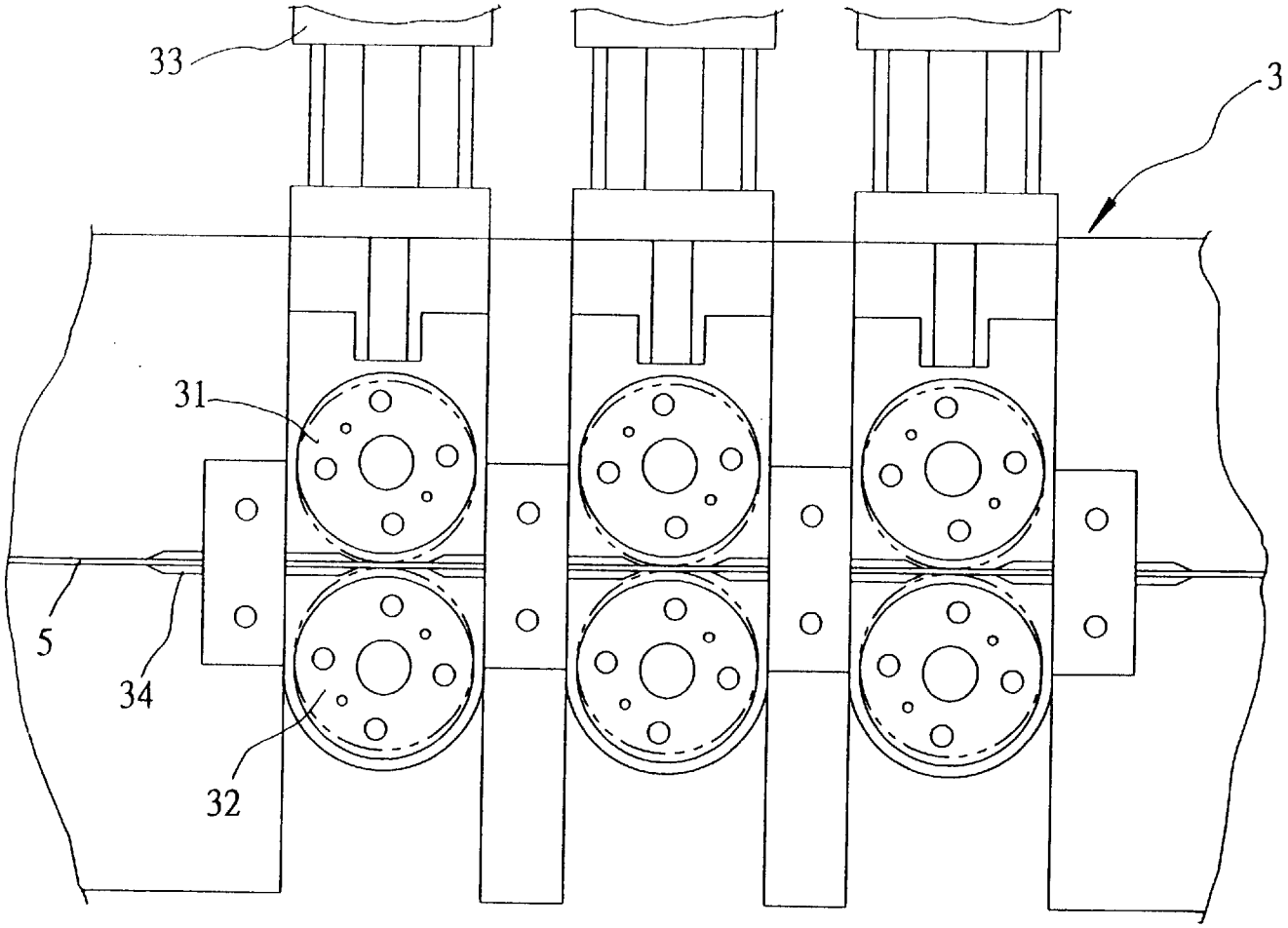
FIG. 4 is a schematic side elevational view, in a larger scale, showing the wire feeding device incorporated in the wire product manufacturing apparatus shown in FIG. 1.

As shown in FIG. 4, the wire feeding means 3 comprises a plurality of pairs of upper and lower rollers 31 and 32. Each of the upper rollers 31 is arranged close to and opposite to the respective lower roller 32 with a gap therebetween.

The rollers 31 and 32 are driven by suitable driving means which is not shown in the drawings to rotate about their own central axes. Each of the upper rollers 31 is associated with a pneumatic cylinder 3 which drives the upper roller 31 to move with respect to the associated lower roller 32 so as to change the gap therebetween. This allows the wire 5 of different size to be properly pinched between and drivingly engaged by the upper and lower roller pairs. The wire feeding means 3 also comprises a guide rail 34 arranged next to the gap between the rollers 3 1 and 32 for guiding the movement of the wire 5 through the wire feeding means 3 toward the wire rotating section 2.

Figure 2:
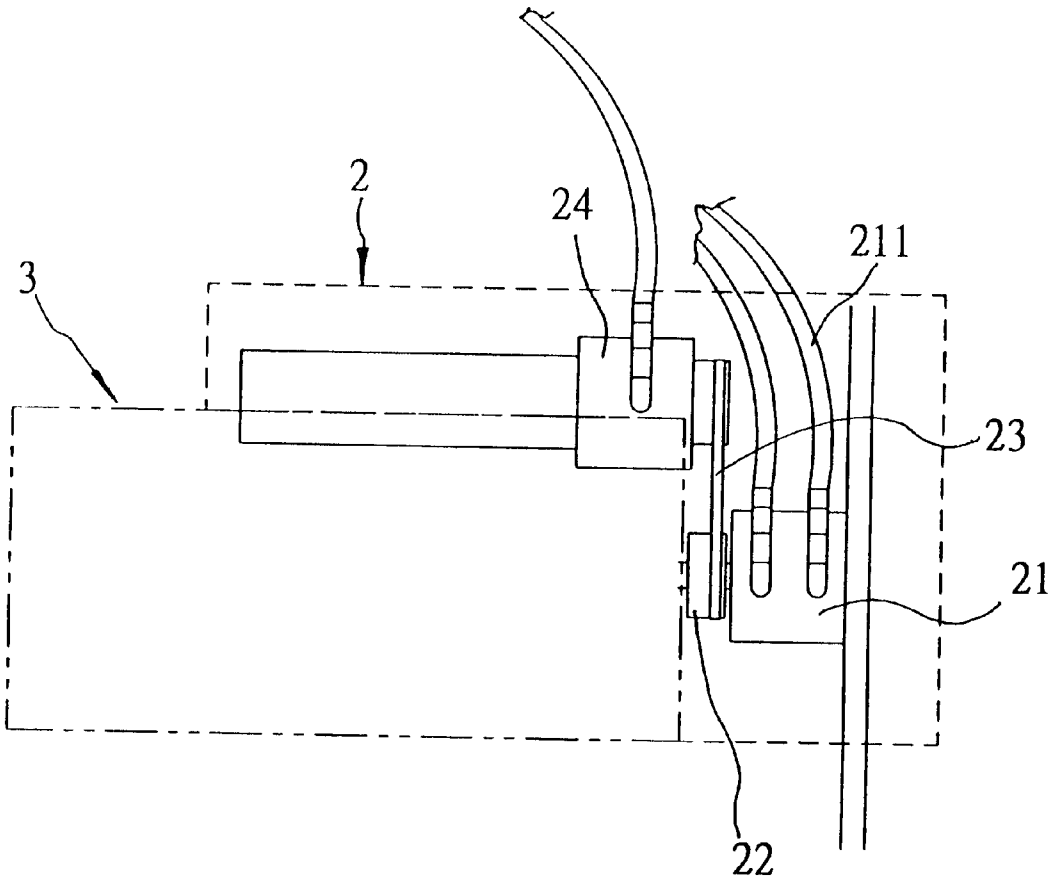
FIG. 2 is a schematic side elevational view, in a larger scale, showing the wire guiding section and the wire rotating section incorporated in the wire product manufacturing apparatus shown in FIG. 1.

As shown in FIG. 2, the wire rotating section 2 comprises a wire holding device through which the wire 5 extends and which is selectively actuated to clamp the wire 5 and a driving device which is to rotate the wire holding device so as to rotate the wire 5 held by the wire holding device about a central axis of the wire 5.

Figure 3:
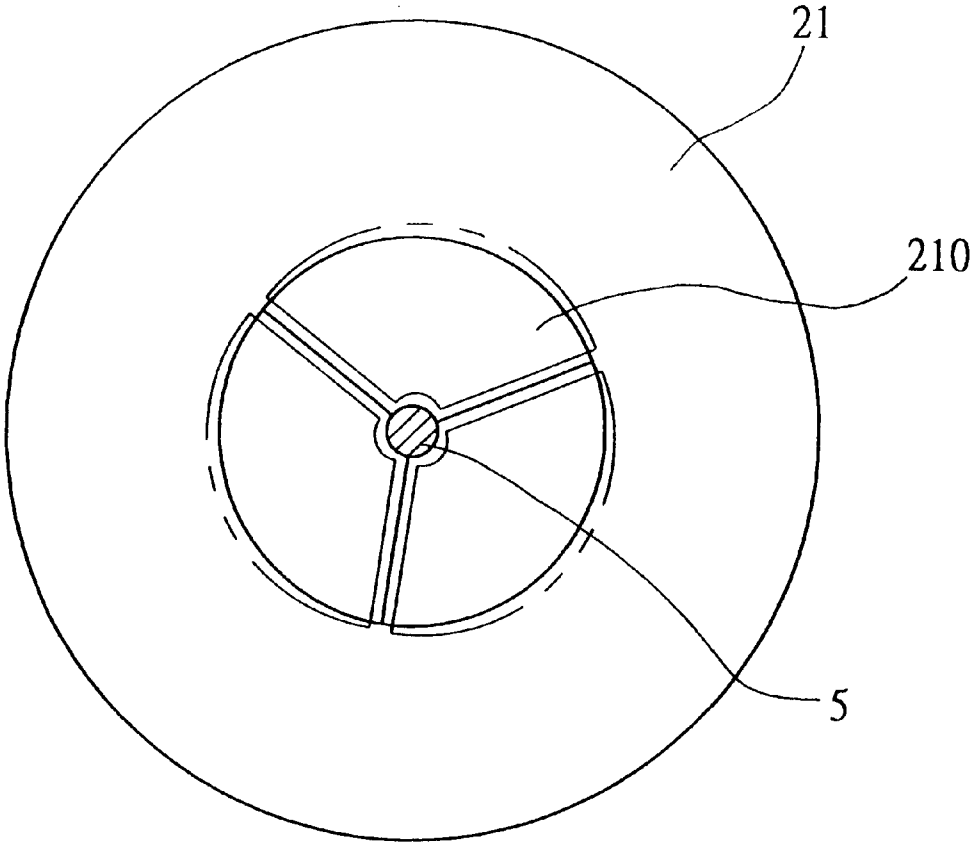
FIG. 3 is an end view showing the wire holding device of the wire rotating section shown in FIG. 2.

The wire holding device in the embodiment illustrated comprises a chuck 21 in which a plurality of chuck blocks 210 (also see FIG. 3) are arranged to be movable in a radial direction with respect to a wire passage defined on a central axis of the chuck 21. The wire 5 extends through the wire passage toward the shaping means 4. The chuck 21 comprises compressed air inlet hoses 211 which supply compressed air to the chuck 21 for controlling the movement of each of the chuck blocks 210 toward/away from the chuck central axis for clamping the wire 5 extending therethrough along the chuck central axis. This is similar to the chuck of a lathe and using compressed air to control the movement of the chuck blocks is also known, so that no detail is needed herein.

The driving device of the wire rotating section 2 comprises a driven pulley 22 fixed to the chuck 21 and a motor 24, preferably a servo motor, having a driving pulley coupled to the driven pulley 22 by means of a belt 23. The motor 24 is controlled by means of for example computer software to determine the rotation angle thereof and thus the angular displacement of the wire 5. The motor 24 drives, via the belt 23, the chuck 2 1 to rotate in a controlled manner.

Figure 5:
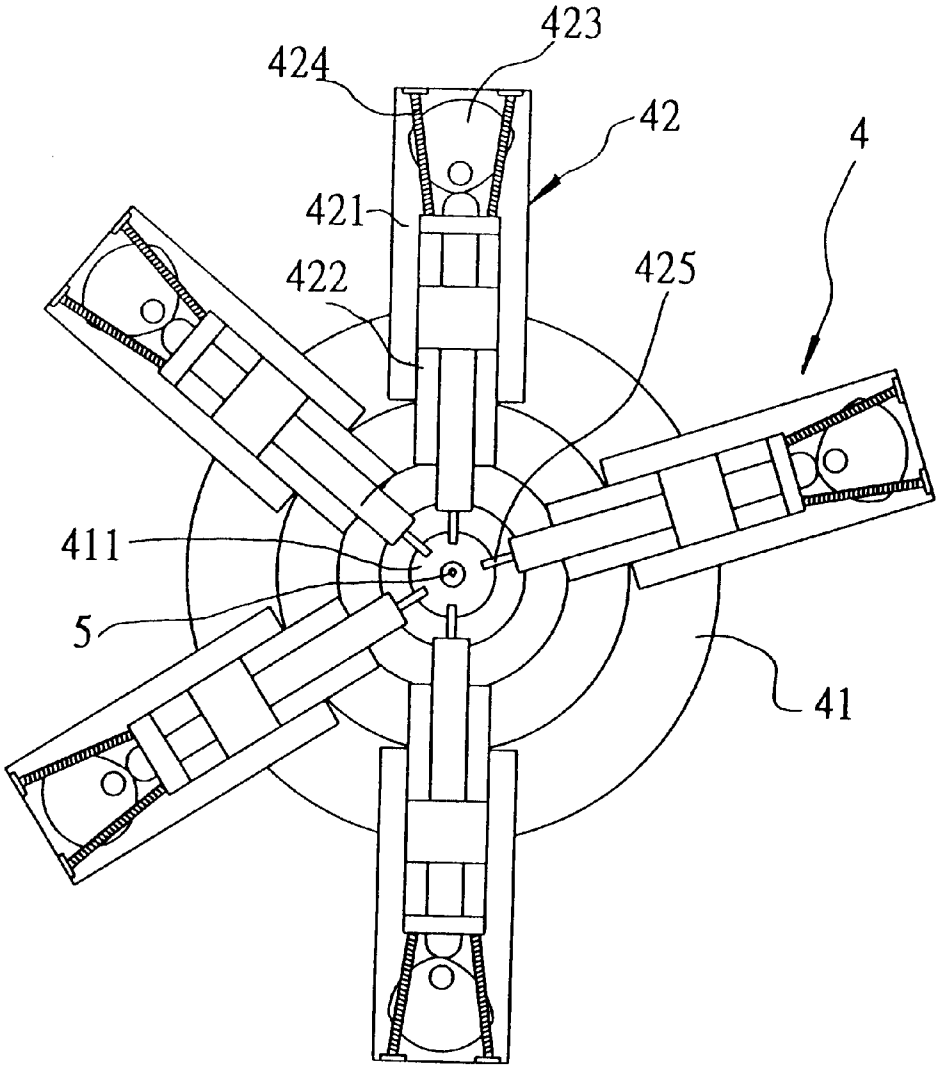
FIG. 5 is an end view showing, in a larger scale, the wire shaping device incorporated in the wire product manufacturing apparatus shown in FIG. 1.
Figure 6:
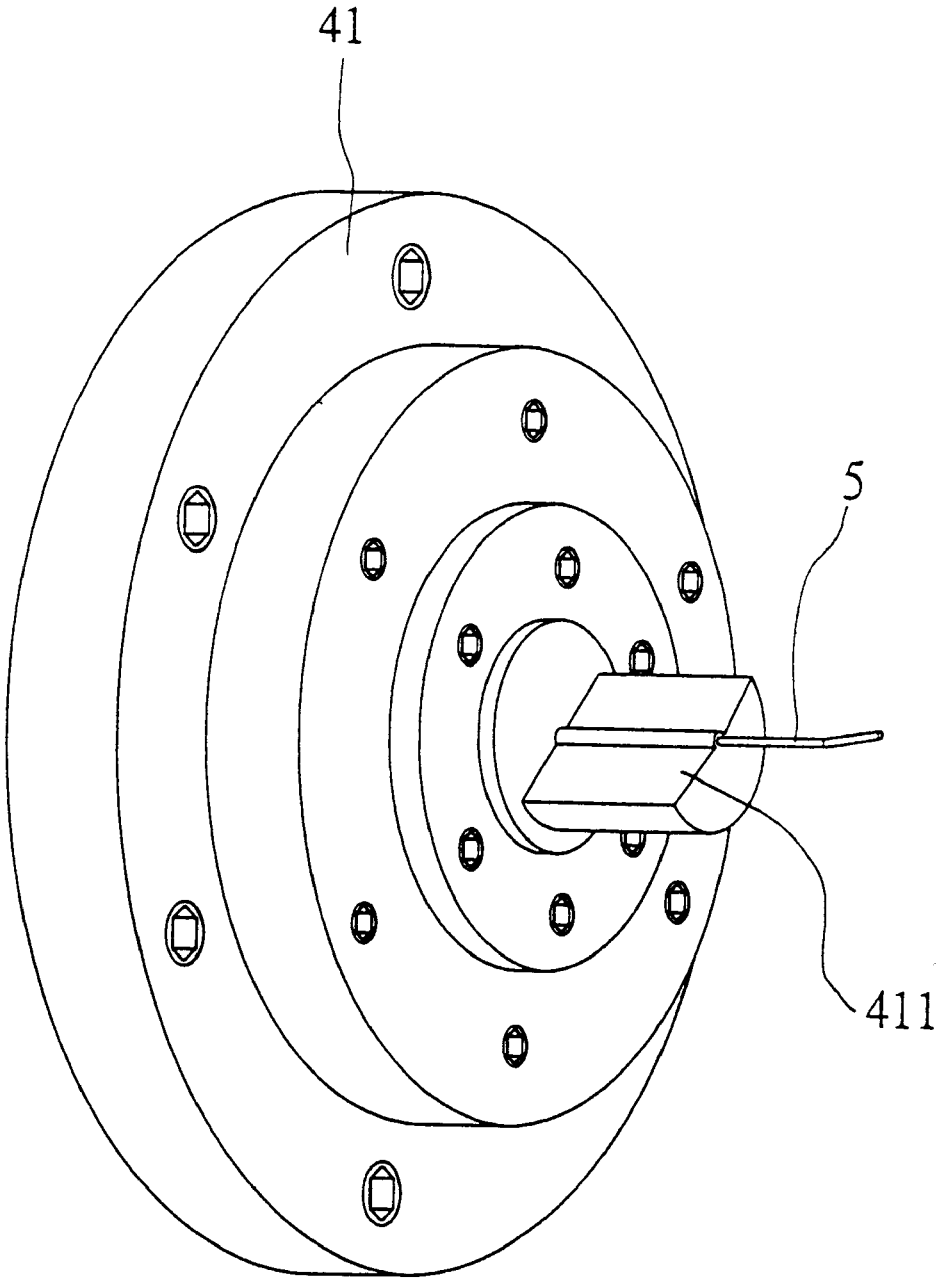
FIG. 6 is a perspective view showing the base of the wire shaping device incorporated in the wire product manufacturing apparatus in accordance with the present invention.

As shown in FIGS. 1, 5 and 6, the shaping means 4 comprises a circular base 41 having a head 411 with a central bore formed thereon. The central bore is sized to allow the wire 5 to move therethrough. The base 41 comprises a plurality of wire shaping tool sets 42 which are arranged in a radial fashion and spaced from each other along an imaginary circle surrounding the central bore. Each of the tool sets 42 comprises a wire shaping tool 425 having a working edge or tip radially facing the central bore. The tool set 42 comprises a slide support 421 mounted on the base 41 on which a slide 422 is slidably supported with the wire shaping tool 425 fixed on the slide 422. A cam 423 is fixed on each of the slide supports 421 and driven by driving means that is not shown in the drawings. The slide 422 is provided with a follower that is engaged by the cam 423 so that when the cam 423 is driven to rotate, the slide 422 is forced to move radially by means of the cam-follower engagement. The slide 422 is biased by springs 424 to provide and ensure the cam-follower engagement between the slide 422 and the cam 423.

By means of the arrangement described above, the wire 5 which may be for example wire for making springs is arranged to extend between the guide rollers 12 and pass through between the upper and lower rollers 31 and 32 of the wire feeding means 3 in order to run through the chuck 21 of the wire rotating section 2 and finally through the central bore of the head 411 of the shaping means 4. In operation, the upper rollers 31 are moved toward the lower rollers 32 by the pneumatic cylinders 33 to pinch the wire 5 therebetween so that by means of the rotation of the rollers 31 and 32 the wire 5 is fed into the central bore of the circular base 41 of the shaping means 4 through the chuck 21. It should be noted that when the wire 5 is moved forward by means of the rollers 31 and 32, the chuck 21 is in a released condition, namely the chuck blocks 210 are moved away from each other to allow the wire 5 to freely move therethrough without any constraint. The rotation angle of the upper and lower rollers 31 and 32 is controlled by means of computer software so that the length of the wire 5 that is fed through the central bore of the shaping means 4 is precisely controlled. Once a desired length of the wire 5 is fed through the central bore of the shaping means 4, the wire shaping tools 421 of the shaping tool sets 42 are controlled to work on the wire 5 for example bending the wire 5. During the wire shaping operation, the chuck 21 may be selectively actuated to have chuck blocks 210 engage and clamp the wire 5 and then the chuck 21 may be selectively driven to rotate a predetermined angle by means of the motor 24. This twists the wire 5 of an angle corresponding to the angular displacement of the chuck 21. Such tool working step and the twisting step may be alternately performed and thus a wire product of for example a polygonal configuration may be formed.

In accordance with an aspect of the present invention, a special tool set 42 may be used to secure the leading end of the wire 5. Thereafter, the wire 5 is continuously fed through the central bore of the head 411 of the shaping means 4. This winds the wire 5 to form for example a helical spring or the like.

Furthermore, in accordance with a further aspect of the present invention, the wire 5 may be rotated to have any desired angular displacement so that a single tool set 42 may be sufficient to operate on the wire 5 by being controlled by computer software. The software may be modified as desired and thus different wire products made of the wire 5 may be manufactured. This allows the number of the tool sets 42 to be reduced and the positions of the tool sets 42 need no modification in switching to manufacture different products. Costs associated with material, labor and time may be significantly cut down.

It is apparent that although the present invention is illustrated with the description of the preferred embodiment thereof, it is contemplated that there may be changes and modifications in the described embodiment that can be carried out without departing from the scope of the invention which is intended to be limited only by the appended claims. All these variation and modification should be considered within the scope of the present invention.

What is claimed is:

1. A wire product manufacturing apparatus adapted to receive a wire from a supply and operate on the wire to form a wire product, the wire product manufacturing apparatus comprising a wire guiding section which receives the wire from the wire supply and guides the wire toward wire feeding means which feeds a predetermined length of the wire to shaping means, the shaping means comprising tool sets, each having a wire operating tool controlled by suitable controlling means to sequentially operate on the wire, the improvement comprising a wire rotating section arranged between the wire feeding means and the shaping means to allow the wire to extend therethrough from the wire feeding means to the shaping means, the wire rotating section comprising a wire holding member which comprises a chuck having a wire passage through which the wire extends toward the shaping means, the chuck further comprising a plurality of chuck blocks which are arranged to surround the wire passage and are radially movable so as to selectively clamp the wire extending through the wire passage and through the wire rotating section and driving means which selectively drives the wire holding member to rotate and thus causing an angular displacement of the wire about a central axis of the wire.

2. The wire product manufacturing apparatus as claimed in claim 1, wherein the driving means for rotating the wire holding member comprises an electrical motor which is mechanically coupled to the wire holding member by means of a pulley and belt system.

3. The wire product manufacturing apparatus as claimed in claim 1, wherein the wire guiding section comprises two roller supports which are arranged to be substantially perpendicular to each other and supported on a rotatable shaft, each of the roller supports comprising two rows of guide rollers arranged in an alternate fashion to guide the wire moving through therebetween.

4. The wire product manufacturing apparatus as claimed in claim 3, wherein the wire feeding means comprises a plurality of pairs of upper and lower rollers arranged to be opposite to each other and defining therebetween a gap through which the wire extends, a first one of the upper and lower rollers being movable with respect to a second one of the upper and lower rollers so as to change the gap for selectively pinching and drivingly engaging the wire, the rollers being driven to rotate so as to feed the wire to the shaping means.

5. The wire product manufacturing apparatus as claimed in claim 4, wherein the wire feeding means further comprises means to guide the movement of the wire through the upper and lower rollers.

6. The wire product manufacturing apparatus as claimed in claim 4, wherein the wire feeding means further comprises pneumatic cylinder means to drive said first one of the upper and the lower rollers to move with respect to said second one of the upper and lower rollers.

7. The wire product manufacturing apparatus as claimed in claim 1 wherein the shaping means comprises a base having a central bore through which the predetermined length of the wire extends, the tool sets being arranged to surround the central bore with the tools radially movable with respect to the central bore.

8. The wire product manufacturing apparatus as claimed in claim 7, wherein each of the tool sets comprises a support mounted on the base, a slide movably supported on the support and wherein the controlling means for controlling the tool comprises a cam which is engageable with a follower provided on the slide, the slide being spring-biased to ensure a proper engagement between the cam and the follower.

* * * * *